US007720398B2

(12) United States Patent
Fukui

(10) Patent No.: US 7,720,398 B2
(45) Date of Patent: May 18, 2010

(54) IMAGE FORMING APPARATUS

(75) Inventor: Norio Fukui, Osaka (JP)

(73) Assignee: Kyocera Mita Corporation (JP)

( * ) Notice: Subject to any disclaimer, the term of this patent is extended or adjusted under 35 U.S.C. 154(b) by 597 days.

(21) Appl. No.: 11/504,501

(22) Filed: Aug. 15, 2006

(65) Prior Publication Data

US 2008/0044189 A1 Feb. 21, 2008

(51) Int. Cl.
*G03G 21/00* (2006.01)
*G03G 15/00* (2006.01)

(52) U.S. Cl. ..... 399/34; 399/9; 399/21

(58) Field of Classification Search ..... 399/21, 399/20, 9, 16, 34; *G03G 15/00, 21/00*
See application file for complete search history.

(56) References Cited

U.S. PATENT DOCUMENTS

| | | | | |
|---|---|---|---|---|
| 5,655,177 | A * | 8/1997 | Kato | 399/69 |
| 5,894,358 | A * | 4/1999 | Ebner et al. | 358/529 |
| 6,122,464 | A | 9/2000 | Kakigi | |
| 6,612,680 | B1 * | 9/2003 | King et al. | 347/19 |
| 2004/0028419 | A1 * | 2/2004 | Kato | 399/27 |
| 2006/0245782 | A1 * | 11/2006 | Hirai et al. | 399/101 |
| 2006/0257157 | A1 * | 11/2006 | Kim et al. | 399/21 |

FOREIGN PATENT DOCUMENTS

| | | | |
|---|---|---|---|
| JP | 04096077 | A * | 3/1992 |
| JP | 11-70719 | | 3/1999 |
| JP | 2000-86014 | | 3/2000 |
| JP | 2000293070 | A * | 10/2000 |
| JP | 2001-142323 | | 5/2001 |
| JP | 2003-2477 | | 1/2003 |
| JP | 2003-98888 | | 4/2003 |
| JP | 2003-149979 | | 5/2003 |
| JP | 2004-12660 | | 1/2004 |
| JP | 2004029592 | A * | 1/2004 |

* cited by examiner

*Primary Examiner*—Daniel J Colilla
*Assistant Examiner*—'Wyn' Q Ha
(74) *Attorney, Agent, or Firm*—Gerald E. Hespos

(57) ABSTRACT

If, upon an occurrence of a jam, a sheet is detected by a sensor disposed downstream of a fixing portion or the leading end thereof has not reached this sensor and a coverage rate is high, the jam is judged to have occurred in the fixing portion. A number (x) of blank sheets to be passed is determined from a coverage rate of the entire sheet, and a cleaning mode is automatically executed if the automatic execution of the cleaning mode is selected, whereas a notification urging the input of an instruction as to whether or not to execute the cleaning mode is given if the automatic notification is selected. Therefore, toner adhered to the fixing portion can be simply and properly cleaned.

6 Claims, 3 Drawing Sheets

IMAGE FORMING APPARATUS

BACKGROUND OF THE INVENTION

1. Field of the Invention

The present invention relates to an image forming apparatus as exemplified by a printer, a copier, and a facsimile machine and particularly to a cleaning technique for a fixing device upon a recovery from a sheet jam.

2. Description of the Related Art

Conventionally, a jam has frequently occurred in a fixing portion in an electrophotographic image forming apparatus. Upon an occurrence of the jam in the fixing portion, there is a strong possibility of adherence of unfixed toner, which is not fixed to a sheet yet, to a heating roller and a pressure roller. For example, in the case of a jam of a sheet that has not yet passed the fixing portion after passing a registration roller, the sheet may be accordion-folded before fixing rollers. This accordion-folded sheet is pressed against the fixing rollers to smear the fixing rollers. Further, in the case of a fixing-portion residence time overrun jam where a sheet remains in the fixing portion for longer than a predetermined period, the apparatus stops with the sheet stuck in the fixing portion. Therefore, there is a likelihood that the unfixed toner on the sheet is adhered to the fixing rollers.

Most of cases where the heating roller and the pressure roller constituting the fixing rollers are smeared are caused by jams occurring in the vicinity of the fixing portion. In the case of the smear caused by a jam, there is a problem of smearing several sheets to be printed immediately after the jam is removed, thereby reducing print quality.

On the other hand, Japanese Unexamined Patent Publication No. 2003-149979 discloses a cleaning method according to which residual toner is removed not by applying an oil or the like to fixing rollers to prevent the toner from remaining thereon, but by passing blank sheet(s) to transfer the residual toner from the fixing rollers.

In this publication, there are proposed a method according to which a cleaning operation is manually performed upon being instructed by section of an operation section by a user or a service person, and a method according to which the cleaning operation is automatically performed after the lapse of a predetermined period or after a specified number of sheets are printed. According to either method, the cleaning operation is performed in a standby state where an apparatus main body does not perform printing.

Accordingly, in the case of manually performing the cleaning operation, if the user is not aware of the cleaning operation, no cleaning operation is performed, wherefore there is a problem of smearing several sheets immediately after the jam is removed as with the conventional practice, thereby reducing the print quality. Even in the case of automatically performing the cleaning operation, there is no effect on image smears immediately after an occurrence of a jam since the cleaning operation is performed after the lapse of the predetermined period or after the specified number of sheets are printed. Further, in spite of differing degrees of smearing the rollers depending on a frequency of occurrence of jams during the predetermined period or within a period during which the specified number of sheets are printed, the cleaning operation is performed at constant intervals. This causes a problem that it is continued to perform no cleaning operation despite the gross smear, thereby reducing the print quality, and a problem that the cleaning operation is performed despite only a small degree of smearing, thereby wasting sheets.

Further, since the cleaning operation is performed only in the standby state, if a jam occurs during a job, the cleaning operation is performed after the remaining job is carried out upon a recovery from the jam. Therefore, there is a problem of reducing the print quality in the remaining job.

SUMMARY OF THE INVENTION

The present invention was achieved to solve the aforementioned problems and an object thereof is to provide an image forming apparatus capable of simply and properly cleaning a fixing device upon a recovery from a jam.

Specifically, the present invention is directed to an image forming apparatus, comprising a fixing section for fusing a toner image formed on a sheet by heating to fix the toner image to the sheet; sheet conveyer for conveying the sheet; a jam detector for detecting a sheet jam in the fixing section; a jam recovery detector for detecting a recovery from the sheet jam after the sheet jam is detected by the jam detector; and a controller for causing the sheet conveyer to discharge a sheet having no toner image formed thereon by way of the fixing section if the recovery from the sheet jam is detected by the jam recovery detector.

In the thus constructed image forming apparatus in which the toner image is fixed by heating and fusing, the controller causes the sheet conveyer to discharge a sheet having no toner image formed thereon by way of the fixing section upon the recovery from the jam, thereby cleaning the fixing section.

Accordingly, even if unfixed toner is adhered to the fixing section upon the occurrence of the jam, the fixing section can be cleaned by removing the residual toner through the sheet discharge. Thus, the cleaning operation is simply and properly performed after the jam recovery, thereby improving print quality after the jam recovery.

Further, unlike conventional image forming apparatuses, the cleaning operation is performed even if the apparatus is not in a standby state. Thus, even if a jam occurs during a job, the cleaning is performed immediately after the recovery from the jam, and good print quality can be constantly ensured for the succeeding printing by the remaining job.

DETAILED DESCRIPTION OF THE PREFERRED EMBODIMENTS

Hereinafter, an image forming apparatus according to one embodiment of the present invention is described with reference to the accompanying drawings.

Figure 1:
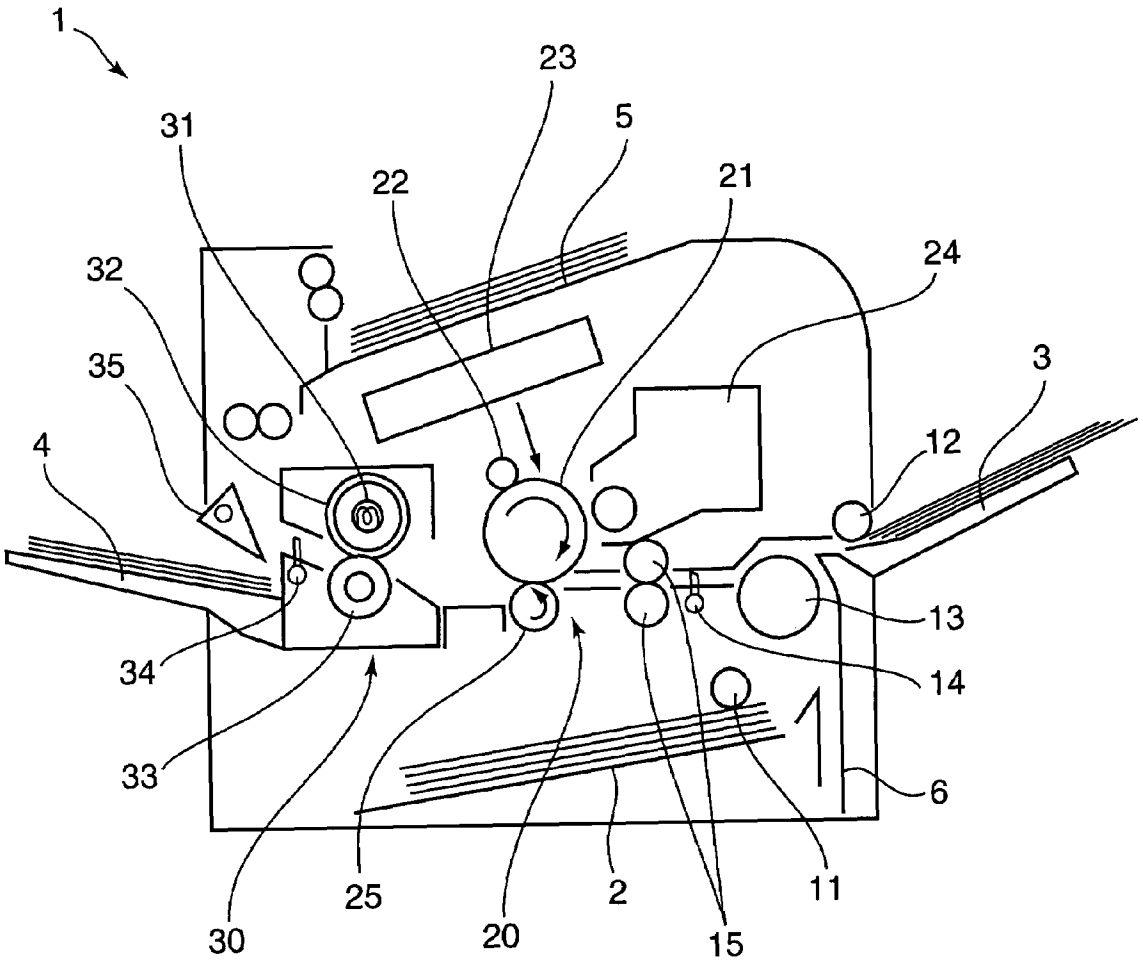
FIG. 1 is a vertical section showing the construction of an image forming apparatus according to one embodiment of the invention.

FIG. 1 is a vertical section showing the construction of an image forming apparatus 1 according to one embodiment of the invention. This image forming apparatus 1 is used as a printer, usable as a copier by working with an image reader and also as a facsimile machine by additionally providing a board for the facsimile machine and connecting a communication line.

This image forming apparatus 1 is provided with a plurality of trays 2, 3, 4, 5 for feeding and discharging sheets, and a sheet feed tray having a large volume can be additionally provided below by a vertical conveyance path 6. Sheets dispensed from the main-body tray 2 and the manual feed tray 3 by pickup rollers 11, 12 and those supplied from the vertical conveyance path 6 are fed to registration rollers 15 via a conveyance roller 13 and a before-registration conveyance sensor 14. The sheet timed with an image forming assembly 20 and having an oblique posture thereof corrected by the registration rollers 15 is fed to the image forming assembly 20.

In the image forming assembly 20, electric charges and residual toner on a photoconductive drum 21 are removed by an unillustrated cleaning section; the photoconductive drum 21 is charged to a predetermined high voltage by a charging roller 22; the photoconductive drum 21 is exposed to a light corresponding to an image to be formed by an exposure section 23 to form an electrostatic latent image on the photoconductive drum 21; and a toner image is transferred to the sheet by a transfer roller 25 after the electrostatic latent image is developed into the toner by a developing section 24.

The sheet discharged from the image forming assembly 20 is conveyed to a fixing portion (one example of fixing section) 30; has the toner image fixed thereto by being heated and pressed by a heating roller 32 heated by a heater lamp 31 and a pressure roller 33 opposed to the heating roller 32; passes a fixing-portion conveyance sensor 34 and a discharging-direction switching guide 35, and is discharged onto the discharged tray 4 at the back side of the main body or the discharge tray 5 atop the main body.

Sheet conveyer is constituted by mechanisms necessary to convey the sheet to the discharge tray 5 or the discharge tray 4 by way of the fixing portion 30 from the manual feed tray 13 or the main-body tray 2 such as the pickup rollers 11, 12, the conveyance roller 13, the registration rollers 15 and the image forming assembly 20. However, the sheet conveyer is not limited to the one constituted by these mechanisms.

The before-registration conveyance sensor 14 disposed upstream of the registration rollers 15 and the fixing-portion conveyance sensor 34 disposed downstream of the fixing portion 30 on the aforementioned sheet conveyance path are, for example, sheet presence detecting sensors of the contact type, and are used for the timing detection and the jam detection. By comparing the conveyance timing of the sheet and the detection states of these sensors 14, 34, an engine controller (one example of jam detector, jam recovery detector) 43 to be described later detects four states, i.e. a registering-portion unreached jam, a registering-portion residence time overrun jam, a fixing-portion unreached jam, and a fixing-portion residence time overrun jam.

Specifically, the engine controller 43 judges the fixing-portion unreached jam in the case where no sheet is detected by the fixing-portion conveyance sensor 34 after the sheet is detected by the before-registration conveyance sensor 14.

Further, the engine controller 43 calculates a time at which the completion of the passage of the sheet is detected by the fixing-portion conveyance sensor 34 based on a time that lapses until the before-registration conveyance sensor 14 is turned off upon detecting the trailing end of the sheet after the before-registration conveyance sensor 14 is turned on upon detecting the leading end of the sheet and a conveyance distance and a conveyance speed from the before-registration conveyance sensor 14 to the fixing-portion conveyance sensor 34, and judges the fixing-portion residence time overrun jam in the case where the completion of the passage of the sheet is not detected by the fixing-portion conveyance sensor 34 (i.e. the trailing end of the sheet is not detected by the fixing-portion conveyance sensor 34 (sensor 34 is kept on)) even upon the lapse of a predetermined period after the calculated time.

Furthermore, the engine controller 43 judges the registering-portion unreached jam in the case where no sheet is detected by the before-registration conveyance sensor 14, and judges the registering-portion residence time overrun jam in the case where the before-registration conveyance sensor 14 detects the residence of the sheet for longer than a predetermined time.

Figure 2:
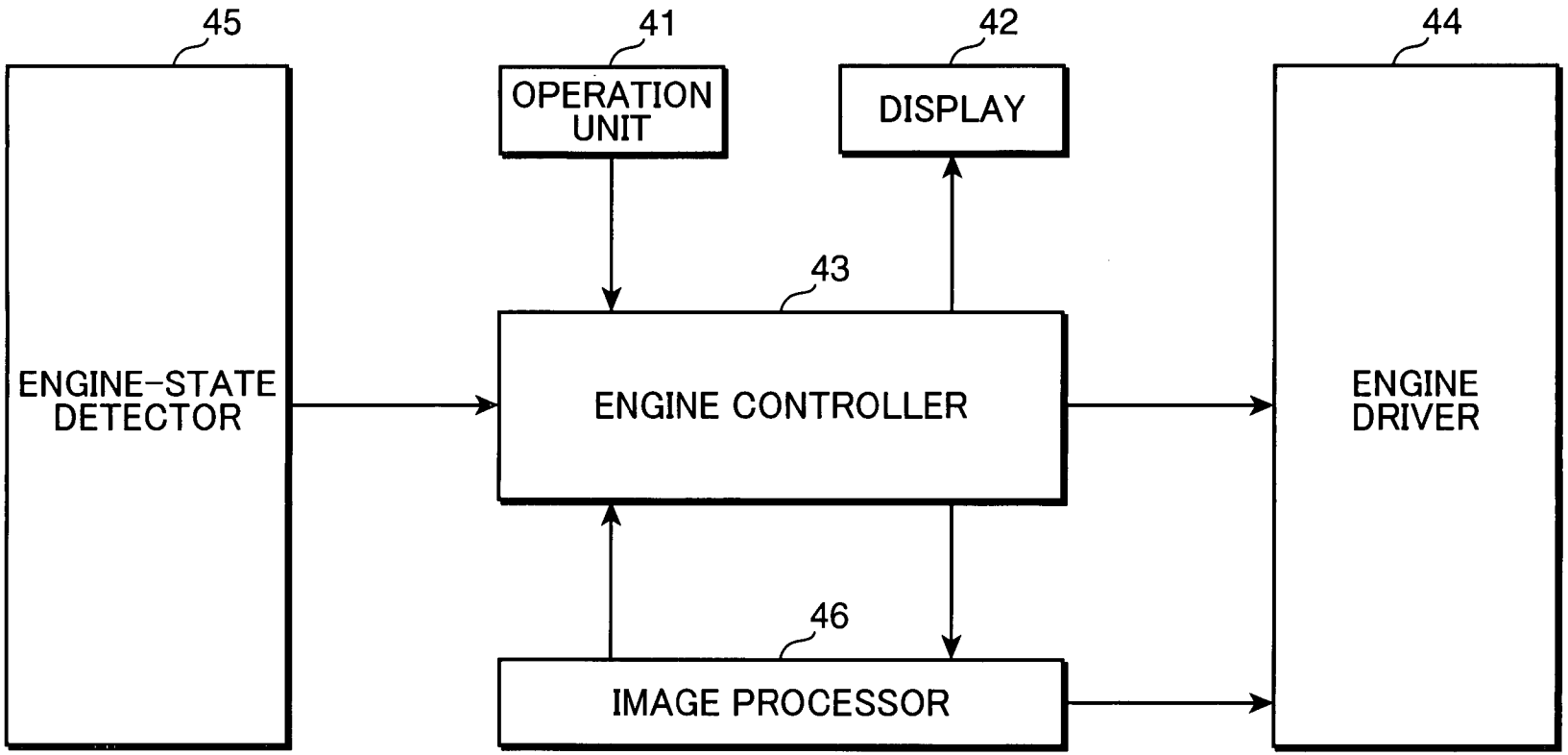
FIG. 2 is a block diagram showing the electrical construction of the image forming apparatus according to the embodiment.

FIG. 2 is a block diagram showing the electrical construction of the image forming apparatus 1 constructed as above. The image forming apparatus 1 is roughly comprised of an operation section (instruction input section, notification instruction input section, tray designation input section) 41, a display section (one example of notification section) 42, the engine controller 43, an engine driver 44, an engine-state detector 45, and an image processor 46.

The engine-state detector 45 timely monitors states of various sensors and switches including the above sensors 14, 34, and notifies the monitored contents to the engine controller 43.

The engine controller 43 constitutes controller and is comprised of a microcomputer and its peripheral circuitry. The engine controller 43 receives state signals from the engine-state detector 45, operation input signals from the operation section 41, and imaging control signals from the image processor 46, and outputs a drive signal to the engine driver 44 after properly processing the received signals. The engine controller 43 also carries out a timing control for the image processor 46 and sets modes. Further, the engine controller 43 causes the display section 42 to display operative states and instructions to a operator.

The image processor (one example of coverage rate calculator) 46 converts image information inputted from an external interface (not shown) into an exposure signal of the exposure section 23 and drives the engine driver 44. This image processor 46 can calculate a coverage rate per print sheet and a coverage rate within a specific area designated beforehand.

In this embodiment, the engine controller 43 normally controls the engine driver 44 and the image processor 46 and causes the display section 42 to make a display as described above. The engine controller 43 causes the engine-state detector 45 to detect the detection states of the sensors 14, 34 during the printing operation and, upon judging an occurrence of a jam in the fixing portion 30, automatically performs a cleaning mode for the rollers 32, 33 by the passage of a blank sheet or automatically causes the display section 42 to display a request to execute the cleaning mode immediately after the jam is removed in accordance with the coverage rate information of the jammed sheet obtained from the image processor 46.

In accordance with the detection results by the detecting sensors 14, 34, the engine controller 43 can detect the four states, i.e. the registering-portion unreached jam, the registering-portion residence time overrun jam, the fixing-portion unreached jam, and the fixing-portion residence time overrun jam. The engine controller 43 automatically perform the cleaning mode as described above or automatically causes the display 42 to display a request to execute the cleaning mode if the detected jam is either one of the fixing-portion unreached jam and the fixing-portion residence time overrun jam having a possibility of adhering smears to the heating roller 32 and the pressure roller 33 of the fixing portion 30.

Figure 3:
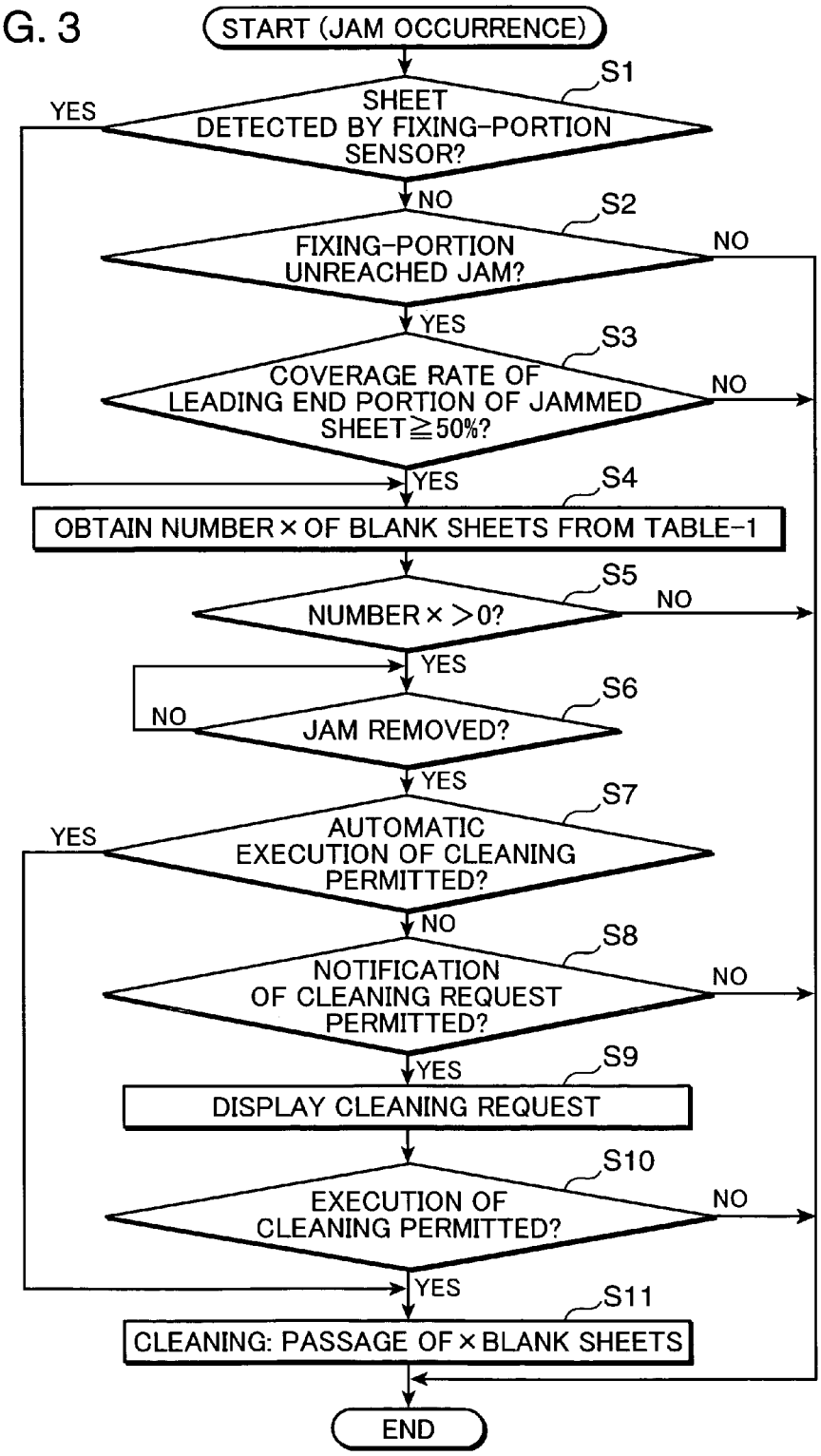
FIG. 3 is a flow chart showing the flow of processings in an engine controller in the case of automatically executing a cleaning mode.

FIG. 3 is a flow chart showing the flow of processings in the engine controller 43 in the case where the cleaning mode is automatically executed.

This cleaning mode is started upon an occurrence of a jam, which is distinguished beforehand, for example, as follows. The engine controller 43 starts counting by a timer interrupt when a sheet is detected by the before-registration conveyance sensor 14, and judges a fixing-portion unreached jam if no sheet is detected by the fixing-portion conveyance sensor 34 even after the lapse of a predetermined first period.

Further, the engine controller 43 starts counting when a sheet is detected by the before-registration conveyance sensor 14, and starts counting again after a count value is reset once by a timer interrupt when the sheet is detected by the fixing-portion conveyance sensor 34 within the first period. The engine controller 43 judges the fixing-portion residence time overrun jam if the sheet is kept detected for longer than a predetermined second period.

Furthermore, the engine controller 43 starts counting by a timer interrupt when an image forming operation is started, and judges the registering-portion unreached jam if no sheet is detected by the before-registration conveyance sensor 14 even after the lapse of a predetermined third period.

Further, the engine controller 43 starts counting by a timer interrupt when an image forming operation is started, starts counting again after a count value is reset once by a timer interrupt when the sheet is detected by the before-registration conveyance sensor 14 within the third period, and judges the registering-portion residence time overrun jam if the sheet is kept detected for longer than a predetermined fourth period.

When an occurrence of a jam is detected in this way, Step S1 follows, in which the engine controller 43 judges whether or not the fixing-portion conveyance sensor 34 is detecting the sheet. If the fixing-portion conveyance sensor 34 is detecting the sheet, the engine controller 43 judges the fixing-portion residence time overrun jam where the sheet remains in the fixing portion 30 and proceeds to Step S4. If the fixing-portion conveyance sensor 34 is detecting no sheet, the engine controller 43 judges another jam and proceeds to Step S2.

In Step S2, the engine controller 43 judges whether or not the jam occurred is the fixing-portion unreached jam where the leading end of the sheet has not yet reached the fixing-portion conveyance sensor 34. The engine controller 43 ends the routine by judging the registering-portion unreached jam or the registering-portion residence time overrun jam by the detection of other sensors if the jam occurred is not the fixing-portion unreached jam.

In Step S3, the engine controller 43 obtains the coverage rate in an area within 30 mm from the leading end of the sheet having caused the jam from the image processor 46, and proceeds to Step S4 if the coverage rate is 50% or higher while ending the routine if it is below 50%. This is because an occurrence of the fixing-portion unreached jam is thought to be a case where the jam occurs before the heating roller 32 or a case where the sheet winds around the heating roller 32 upon parting from the heating roller 32 to be accordion-folded, thereby being unable to reach the fixing-portion conveyance sensor 34. The higher the toner density of the leading end portion of the sheet, the more likely the latter case occurs. Thus, the jammed position can be presumed based on the coverage rate of the leading end portion.

Subsequently, in Step S4, the engine controller 43 obtains the coverage rate of the entire sheet having caused the jam, determines a number x of blank sheets to be passed after the jam is removed in accordance with TABLE-1, and proceeds to Step S5.

TABLE 1

| Coverage Rate P of Jammed Sheet | Number of Blank Sheets x |
|---|---|
| $P > 20\%$ | 0 |
| $20\% \leqq P < 50\%$ | 1 |
| $50\% \leqq P < 80\%$ | 2 |
| $P \leqq 80\%$ | 3 |

In Step S5, the engine controller 43 judges whether or not the number x of blank sheets to be passed is larger than 0, and ends the routine if x=0 while proceeding to Step S6 if x is 1 or larger.

In Step S6, the engine controller 43 enters a standby state until the jammed state is removed, and proceeds to Step S7 when the jammed state is removed.

In Step S7, the engine controller 43 judges whether or not the automatic execution of the cleaning mode is permitted, and proceeds to Step S11 if it is permitted while proceeding to Step S8 if it is prohibited.

In Step S8, the engine controller 43 judges whether or not the automatic notification of the request to execute the cleaning mode is permitted, and proceeds to Step S9 if it is permitted while ending the routine if it is prohibited, i.e. the cleaning mode is unconditionally prohibited.

In Step S9, the engine controller 43 causes the display section 42 to display the request to execute the cleaning mode.

In Step S10, the engine controller 43 waits for the input of the permission/cancellation to execute the cleaning mode from the operation section 41. The engine controller 43 proceeds to Step S11 if the execution of the cleaning mode is permitted in Step S10 while ending the routine if it is canceled.

In Step S11, the engine controller 43 causes x sheets on the feed tray set beforehand to be fed and to be discharged onto the discharge tray set beforehand without performing an image forming operation, and ends the routine.

With this construction, even if the jam causes the unfixed toner to adhere to the heating roller 32 of the fixing portion 30, the residual toner can be removed to clean the heating roller 32 by executing the cleaning mode to pass the blank sheet(s). At this time, the cleaning can be simply and properly performed without burdening an operator by automatically executing the cleaning mode or automatically displaying the request to execute the cleaning mode, wherefore print quality after the recovery of the jam can be improved. Further, since the cleaning operation is performed even if the image forming apparatus 1 is not in the standby state, the cleaning is performed immediately after the recovery from the jam even if the jam occurs during a job and good print quality can be constantly ensured for the succeeding printing by the remaining job.

Even if a jam occurs, the unfixed toner may not adhere to the heating roller 32 depending on the position of jamming. In the case of the aforementioned fixing-portion unreached jam and fixing-portion residence time overrun jam, there is assumed to be a strong possibility that the unfixed toner image on the sheet adheres to the heating roller 32. In these cases, the engine controller 43 automatically executes the cleaning mode or automatically displays the request to execute the cleaning mode. On the other hand, in the case of the registering-portion unreached jam where no sheet is detected by the before-registration conveyance sensor 14 or the registering-portion residence time overrun jam where the residence of the sheet for longer than the predetermined period is detected, there is a low possibility that the unfixed toner image adheres to the heating roller 32. Thus, the engine controller 43 neither automatically executes the cleaning mode nor automatically displays the request to execute the cleaning mode in these cases. Therefore, the cleaning mode of removing the residual toner can be properly performed.

Further, the engine controller 43 calculates the coverage rate of the jammed sheet from the image data, based on which the toner image was formed, in the case of detecting the fixing-portion unreached jam or the fixing-portion residence time overrun jam. If the calculated coverage rate is equal to or higher than the predetermined value (for example the coverage rate in the area within 30 mm from the leading end of the sheet is 50% or higher), the cleaning mode is automatically executed or the request to execute the cleaning mode is automatically displayed. If this coverage rate is below the predetermined value and the unfixed toner is thought to hardly adhere to the heating roller 32, neither the automatic execution of the cleaning mode nor the automatic display of the request to execute the cleaning mode is performed. Therefore, the cleaning mode of removing the residual toner can be properly performed.

Furthermore, since the engine controller 43 determines the number of blank sheets to be passed depending on the coverage rate of the entire sheet having caused the jam, a number of blank sheets corresponding to a smeared degree of the heating roller 32 are passed, whereby the smear can be securely removed while wasting a minimum number of sheets by using them as blank sheets to be passed.

Further, since at least one of the feed tray and the discharge tray for the sheets used as blank sheets to be passed can be designated to the engine controller 43 by the operation section 41 as the tray designation input section, it is possible to use inexpensive sheets, which are normally not used, as blank sheets to be passed and to prevent these sheets from getting mixed with normal printed matters. The selection of the tray(s) may not be predesignated as described above, and a feed tray bearing the sheets and an empty discharge tray may be automatically set at the time of executing the cleaning mode.

Whether the cleaning mode is automatically executed or the request to execute the cleaning mode is automatically displayed upon a recovery from the jam can be designated to the engine controller 43 by the operation section 41 as the notification instruction input section, the cleaning mode can be executed according to the request.

It should be noted that it is sufficient to minimally carry out Steps S1, S2, S6 and S11 according to the embodiment of the present invention.

Further, although the engine controller 43 determines the number x of blank sheet(s) in accordance with the coverage rate in the above description, there is a possibility of performing no cleaning operation despite occurrences of jams if the jams of sheets having low coverage rates successively occur as is clear from TABLE-1. Accordingly, the engine controller (one example of counter) 43 may count the number of occurrences of jams and may perform the cleaning operation when jams have occurred such a number of times that this count value reaches a predetermined value and the unfixed toner adheres to the heating roller 32 to a certain degree. In this way, the number of cleaning operations can be suppressed to a minimum level while ensuring the proper cleaning.

In the case where a full-color image forming apparatus is one embodiment of the present invention, a smeared degree of the heating roller 32 is a sum of coverage rates of the respective color components of black, magenta, cyan and yellow, wherefore the engine controller 43 may set the sum of the coverage rates of the respective color components as the above coverage rate. In this way, full-color printing can be properly dealt with.

In short, the present invention is directed to an image forming apparatus, comprising a fixing section for fusing a toner image formed on a sheet by heating to fix the toner image to the sheet, sheet conveyer for conveying the sheet, a jam detector for detecting a sheet jam in the fixing section, a jam recovery detector for detecting a recovery from the jam after the sheet jam is detected by the sheet jam detector, and a controller for causing the sheet conveyer to pass a sheet having no toner image thereon by way of the fixing section if the recovery from the sheet jam is detected by the jam recovery detector.

According to this image forming apparatus, even if the unfixed toner adheres to the fixing section upon the jam, the residual toner in the fixing section can be removed to clean the fixing section through the sheet discharge. This enables the cleaning to be simply and properly performed after the jam recovery, thereby improving print quality after the jam recovery. Further, unlike the conventional apparatuses, the cleaning operation is performed even if the apparatus is not in the standby state. Thus, even if a jam occurs during a job, the cleaning is performed immediately after the recovery from the jam and good print quality can be constantly ensure for the succeeding printing by the remaining job.

The image forming apparatus according to the present invention further comprises a notification section for notifying an operation guiding message to an operator and an instruction input section to which an operation instruction is inputted by the operator, wherein the controller causes the notification section to notify a message urging the input of an instruction as to whether or not to discharge a sheet having no toner image formed thereon if the recovery of the sheet jam is detected by the jam recovery detector, and causes the sheet conveyer to discharge a sheet having no toner image formed thereon after the notification of the message by the notification section only when the instruction to discharge the sheet having no toner image formed thereon is inputted to the instruction input section by the operator after the notification of the message by the notification section.

According to this image forming apparatus, after the operator is urged to let the blank sheet pass, the cleaning is simply and properly performed after the jam recovery, wherefore print quality after the jam recovery can be improved.

The image forming apparatus according to the present invention further comprises a notification instruction input section to which an instruction as to whether or not to cause the notification section to give the notification is inputted by the operator, wherein the controller causes the notification section to give the notification if the instruction to give the notification is inputted to the notification instruction input section.

According to this image forming apparatus, through the operation of the notification instruction input section by the operator or a service person, the execution of the blank sheet passage as the cleaning operation can be switched between the automatic execution and the one performed after the notification of the passage of the blank sheet(s) to the operator. Therefore, the cleaning operation meeting a request can be performed.

The image forming apparatus according to the present invention further comprises a coverage rate calculator for calculating a coverage rate of the sheet from an image data, based on which the toner image was formed on the sheet, wherein the controller causes the sheet conveyer to discharge the sheet having no toner image formed thereon only when the calculated coverage rate of the sheet having caused the jam by the coverage rate calculator, is equal to or higher than a predetermined value if the recovery from the sheet jam is detected by the jam recovery detector.

According to this image forming apparatus, even if a jam occurs, the controller causes no cleaning operation to be performed if the coverage rate is below the predetermined value and the unfixed toner is thought to hardly adhere to the fixing section. Therefore, blank sheet(s) can be suitably passed to remove the residual toner.

The image forming apparatus according to the present invention further comprises a sheet presence detecting sensors disposed upstream of a registration roller and downstream of the fixing section on a sheet conveyance path, wherein the jam detector judges the sheet jam when no sheet is detected by the sheet presence detecting sensor downstream of the fixing section after the sheet is detected by the sheet presence detecting sensor upstream of the registration roller.

The image forming apparatus according to the present invention further comprises a sheet presence detecting sensors disposed upstream of a registration roller and downstream of the fixing section in a sheet conveyance path, wherein the jam detector calculates a time at which the completion of the passage of the sheet is detected by the sheet presence detecting sensor downstream of the fixing section based on a period that lapses until the absence of the sheet is detected after the presence of the sheet is detected by the sheet presence detecting sensor upstream of the registration roller, and a distance and a speed of the sheet conveyance from the position of the sheet presence detecting sensor upstream of the registration roller to the position of the sheet presence detecting sensor downstream of the fixing section; and judges the sheet jam if the completion of the passage of the sheet is not detected by the sheet presence detecting sensor downstream of the fixing section even upon the lapse of a period predetermined period after the calculated time.

Even if a jam occurs, the unfixed toner may not adhere to the fixing section depending on the position of jamming. Thus, the cleaning operation is performed for cases where the unfixed toner on the sheet adheres to the fixing section with a strong possibility. On the other hand, in the case of a registering-portion unreached jam where no sheet is detected by the sheet presence detecting sensor upstream of the registration roller and a registering-portion residence time overrun jam where the sheet is detected to have remained for longer than a predetermined period, the cleaning operation is not performed for the reason that the unfixed toner image adheres to the fixing section with a low possibility. Accordingly, blank sheet(s) can be properly passed to remove the residual toner.

In the image forming apparatus according to the present invention, the controller determines the number of sheets having no toner images formed thereon and discharged by the sheet conveyer in accordance with the coverage rate.

According to this image forming apparatus, a number of blank sheets corresponding to a smeared degree of the fixing section are passed in accordance with the coverage rate. Therefore, the smear can be securely removed while wasting a minimum number of sheets by using them as blank sheets to be passed.

The image forming apparatus according to the present invention further comprises a coverage rate calculator for calculating a coverage rate of a sheet having caused a sheet jam from an image data, based on which a toner image was formed on the sheet, wherein the controller obtains a coverage rate in a predetermined range of the sheet extending from the leading end of the sheet having caused the sheet jam from the coverage rate calculator if a recovery from the sheet jam is detected by the jam recovery detector, and causes the sheet conveyer to discharge a sheet having no toner image formed thereon only when the coverage rate is equal to or higher than a predetermined value.

With this image forming apparatus, the cleaning operation can be more properly performed by judging whether or not to perform the cleaning operation in consideration of the particular influence of the coverage rate of the leading end portion of the sheet on the smeared degree of the fixing section.

The image forming apparatus according to the present invention further comprises a counter for counting the number of occurrences of jams in the fixing section, wherein the controller causes the sheet conveyer to discharge a sheet having no toner image formed thereon every time a count value of the counter reaches a predetermined value.

If whether or not to perform the cleaning operation is determined according to the coverage rate, there is a possibility of not performing any cleaning operation despite successive occurrences of jams of sheets having low coverage rates. With the above construction, the cleaning operation is performed when the unfixed toner is thought to adhere to the fixing section to a certain degree because of jams having occurred a predetermined number of times. Therefore, the number of the cleaning operations can be suppressed to a minimum level while performing proper cleaning.

The image forming apparatus according to the present invention is a full-color image forming apparatus, wherein the coverage rate calculator calculates a coverage rate of each color from an image data of each color for forming a full-color image, and sets a sum value of the coverage rates of the respective colors as a coverage rate serving as a judgment criterion as to whether or not to cause the sheet conveyer to discharge a sheet having no toner image formed thereon.

With this image forming apparatus, the fixing section can be properly cleaned in accordance with characteristics of the full-color image forming apparatus in which a smeared degree of heating roller is in proportional to the sum of the coverage rates of the respective color components.

The image forming apparatus according to the present invention further comprises a tray designation input section to which an operator inputs an instruction to designate at least either one of a discharge tray for sheets having no toner images formed thereon and a feed tray for sheets having no toner images formed thereon, wherein the controller causes the sheet conveyer to discharge a sheet onto the discharge tray designated by the instruction inputted to the tray designation input section or to pick up a sheet from the feed tray designated by the instruction inputted to the tray designation input section.

With this image forming apparatus, the operator can arbitrarily designate at least either one of the feed tray and the discharge tray for sheets used for the passage of blank sheets, wherefore it is possible to use inexpensive sheets, which are normally not used, as blank sheets to be passed and to prevent these sheets from getting mixed with normal printed matters.

This application is based on patent application No. 2005-251680 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A full-color image forming apparatus, comprising:

a fixing section that fuses a toner image formed on a sheet by heating to fix the toner image to the sheet, a sheet conveyer for conveying the sheet, a jam detector that detects a sheet jam in the fixing section, a jam recovery detector for detecting a recovery from the sheet jam after the sheet jam is detected by the jam detector, a coverage rate calculator that calculates a coverage rate of a sheet from an image data, based on which toner image was formed on the sheet, and a controller that causes the sheet conveyer to discharge a sheet having no toner image formed thereon by way of the fixing section if the recovery from the sheet jam is detected by the jam recovery detector and if the calculated coverage rate of the sheet that caused the jam, as calculated by the coverage rate calculator, is equal to or higher than a predetermined value, wherein the coverage rate calculator calculates a coverage rate of each color from an image data for forming a full-color image, and sets a sum value of the coverage rates of the respective colors as a coverage rate serving as a judgment criteria by the controller as to determine a quantity of sheets having no toner image formed thereon to be discharged by the sheet conveyer.

2. An image forming apparatus according to claim 1, further comprising:

a notification section that notifies an operation guiding message to an operator, and an instruction input section to which an operation instruction is inputted by the operator, wherein the controller causes the notification section to notify a message urging the input of an instruction as to whether or not to discharge a sheet having no toner image formed thereon if the recovery from the sheet jam is detected by the jam recovery detector, and causes the sheet conveyer to discharge a sheet having no toner image formed thereon only when an instruction to discharge the sheet having no toner image formed thereon is inputted to the instruction input section by the operator after the notification of the message by the notification section.

3. An image forming apparatus according to claim 2, further comprising notification instruction input section to which an instruction as to whether or not to cause the notification section to give the notification is inputted by the operator, wherein the controller causes the notification section to give the notification if the instruction to give the notification is inputted to the notification instruction input section.

4. An image forming apparatus according to claim 1, further comprising a sheet presence detecting sensors disposed upstream of a registration roller and downstream of the fixing section on a sheet conveyance path, wherein the jam detector judges the sheet jam when no sheet is detected by the sheet presence detecting sensor downstream of the fixing section after the sheet is detected by the sheet presence detecting sensor upstream of the registration roller.

5. An image forming apparatus according to claim 1, further comprising a sheet presence detecting sensors disposed upstream of a registration roller and downstream of the fixing section on a sheet conveyance path, wherein the jam detector calculates a time at which the completion of the passage of the sheet is detected by the sheet presence detecting sensor downstream of the fixing section based on a period that lapses until the absence of the sheet is detected after the presence of the sheet is detected by the sheet presence detecting sensor upstream of the registration roller, and a distance and a speed of the sheet conveyance from the position of the sheet presence detecting sensor upstream of the registration roller to the position of the sheet presence detecting sensor downstream of the fixing section; and judges the sheet jam if the completion of the passage of the sheet is not detected by the sheet presence detecting sensor downstream of the fixing section even upon the lapse of a predetermined period after the calculated time.

6. An image forming apparatus according to claim 1, further comprising a tray designation input section to which an operator inputs an instruction to designate at least either one of a discharge tray for sheets having no toner images formed thereon and a feed tray for sheets having no toner images formed thereon, wherein the controller causes the sheet conveyer to discharge a sheet onto the discharge tray designated by the instruction inputted to the tray designation input section or to pick up a sheet from the feed tray designated by the instruction inputted to the tray designation input section.

* * * * *